US006152388A

United States Patent [19]

Rohloff

[11] Patent Number: 6,152,388

[45] Date of Patent: Nov. 28, 2000

[54] SPRAY NOZZLE APPARATUS

[76] Inventor: Terry Rohloff, 3212 Valley Ridge Dr., Eagan, Minn. 55121

[21] Appl. No.: 09/317,331

[22] Filed: May 24, 1999

[51] Int. Cl.[7] ..... B05B 1/00

[52] U.S. Cl. ..... 239/600; 239/550

[58] Field of Search ..... 239/271, 272, 239/550, 548, 600; 285/197–199

[56] References Cited

U.S. PATENT DOCUMENTS 2,946,518 7/1960 Wahlin ..... 239/600 X 3,009,655 11/1961 Palmer ..... 239/600 X 5,234,161 8/1993 Harrison, Jr. et al. ..... 239/600 X

*Primary Examiner*—Lesley D. Morris

*Attorney, Agent, or Firm*—Merchant & Gould P.C.

[57] ABSTRACT

Spray nozzle apparatus for use along the boom of a liquid spraying implement. The spray nozzle apparatus includes a nipple extending upwardly into the distribution pipe when the body of the spray nozzle assembly is clamped to the pipe. The nipple includes notches along the longitudinal direction of the pipe so that when the system is drained, all liquid can drain from the pipe through the notches.

2 Claims, 2 Drawing Sheets

SPRAY NOZZLE APPARATUS

FIELD OF THE INVENTION

The invention is directed to spray nozzle devices used on liquid spraying implements commonly having booms for supporting a plurality of such spray nozzle devices therealong.

BACKGROUND OF THE INVENTION

The spraying of various liquids on agricultural fields, for example, fertilizers, weed killers, etc., is common with respect to most types of farming and for most types of crops. The liquids tend to be expensive. They can also be caustic or otherwise pose some danger, not only to implement operators, but to plant life for which the liquids may not be designed. It is necessary to carefully control spraying. In this regard, it is important to fully clean the spraying implement when switching from one liquid to be sprayed to another. In particular, there has been the problem that remnants of the liquid last sprayed remain in the system when a new liquid to be sprayed is loaded in the system.

SUMMARY OF THE INVENTION

The spray nozzle apparatus of the present invention provides apparatus which allows for complete drainage of liquid from a distribution pipe when the spray system has been shut-off. In this regard, the spray nozzle apparatus of the present invention attaches with a clamp to a distribution pipe. The pipe has a wall with outer and inner surface and has an opening at a lower most location along the wall. The apparatus includes a body with a saddle for mating with the clamp. The body includes a nipple protruding up from the saddle so as to project through the opening in the pipe when the clamp attaches the assembly to the pipe. The nipple has a notch in opposite walls such that the notches are beneath the inner surface of the wall of the pipe when the assembly is attached to the pipe so that liquid cannot accumulate between the nipple and the inner surface of the pipe.

DETAILED DESCRIPTION OF THE PREFERRED EMBODIMENT

Figure 1:
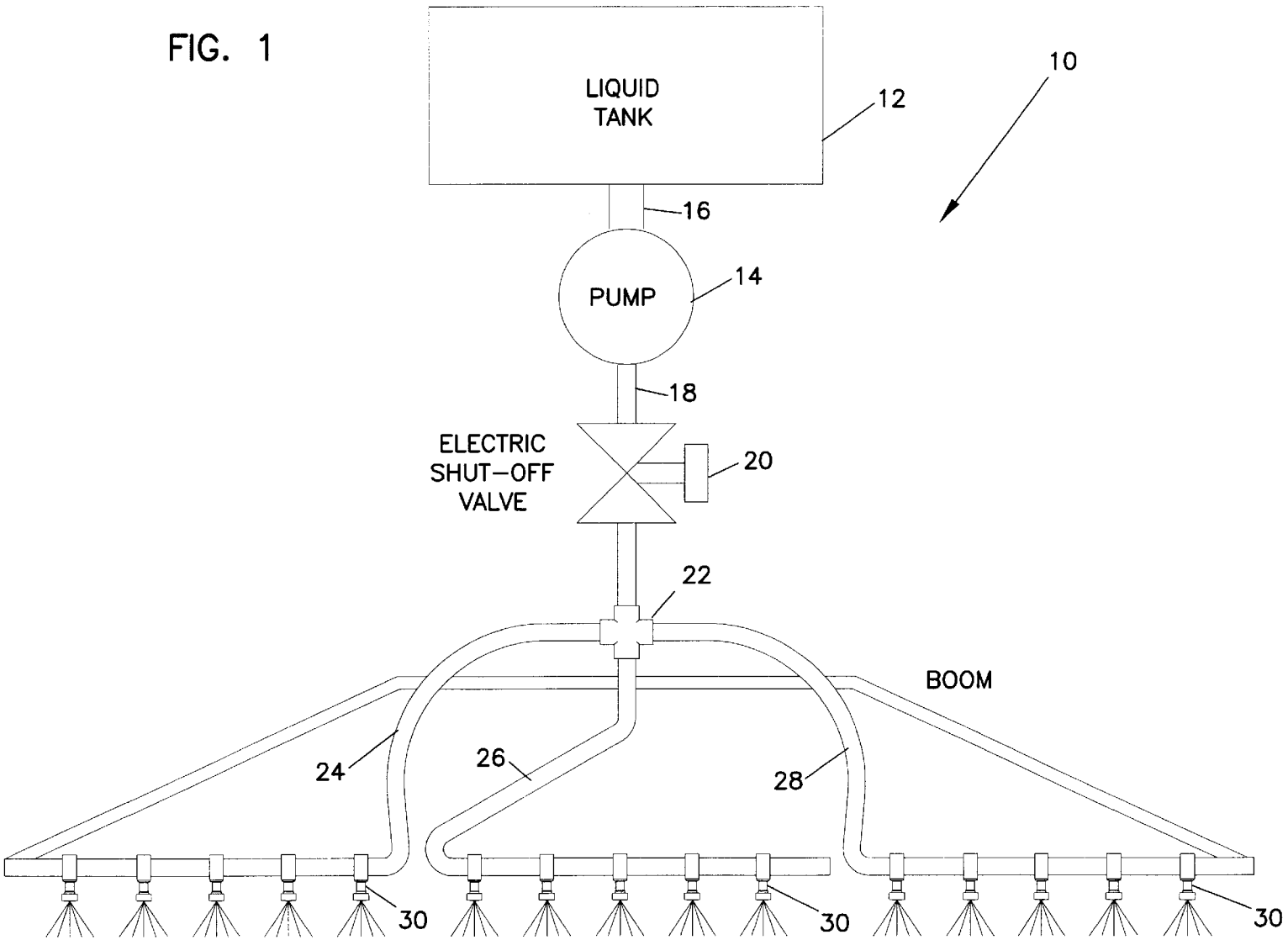
FIG. 1 is a schematic illustration of a spraying instrument having nozzle apparatus in accordance with the present invention.

Referring now to the drawings wherein like reference numerals designate identical or corresponding parts throughout the several views, and more particularly to FIG. 1, a representative plumbing system is designated generally by the numeral 10. System 10 could be vastly more complex and is intended for mounting on a spray implement having a boom structure. System 10, however, has purposely been made simple for the sake of clarity. System I0 includes a tank 12 for providing a reservoir for the liquid to be sprayed.

A pump 14 receives liquid via a tube or pipe 16. The liquid to be sprayed is pumped via a tube or pipe 18 which has a shut-off valve 20 therein to a manifold 22. A plurality of tubes or pipes 24, 26, 28 are directed in a fashion to be supported by the boom structure (shown partially schematically). A plurality of nozzle assemblies 30 are mounted on, for example, pipe 26.

Figure 2:
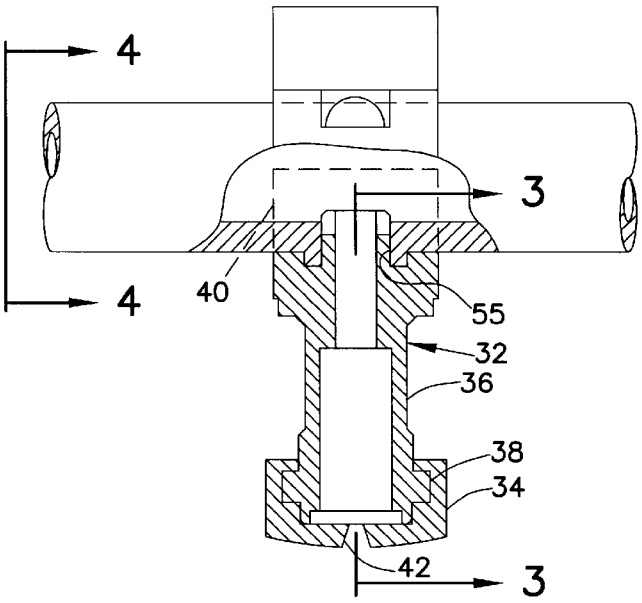
FIG. 2 is a cross-sectional view of spray nozzle apparatus in accordance with the present invention, with a portion of the saddle broken away for clarity.

A representative form of nozzle assembly 30 in accordance with the present invention is shown in FIG. 2. The nozzle assembly 30 includes a body 32 and a nozzle tip 34. Body 32 includes a main portion 36 with an engagement portion 38 at the downstream end and a saddle 40 at the upstream end. A nozzle tip 34 engages with engagement portion 38 to provide a nozzle 42 at the downstream end of the spray nozzle assembly 30.

Figure 3:
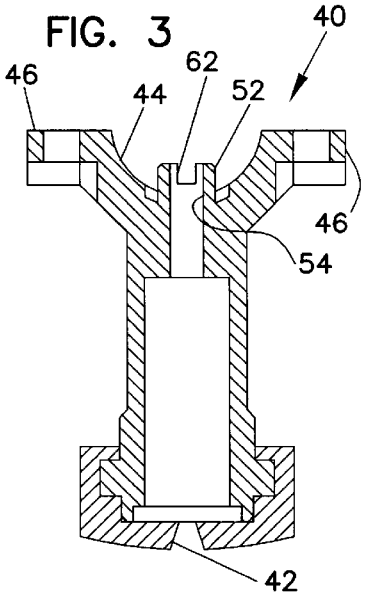
FIG. 3 is a cross-sectional view taken along the line 3—3 of FIG. 2.
Figure 4:
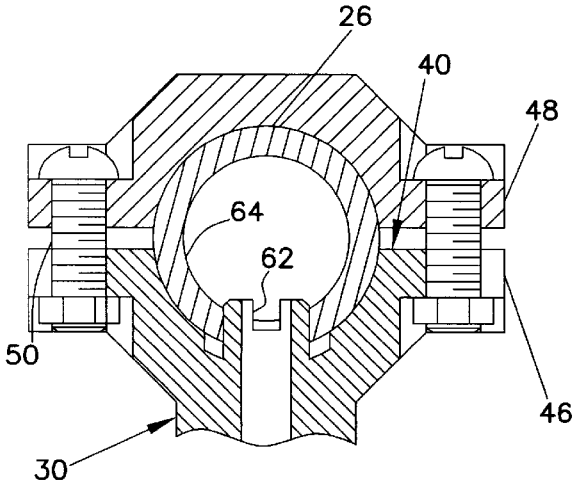
FIG. 4 is a view looking into the pipe as taken along line 4—4 of FIG. 2.

As shown in FIG. 3, saddle 40 includes a pipe engagement portion 44 and a pair of first flanges 46 on opposite sides thereof. As shown in FIG. 4, saddle 40 mates with clamp 48 to attach spray nozzle assembly 30 to pipe 26. A pair of screws 50 on opposite sides of pipe 26 attached flanges 46 to clamp 48.

Assuming the pipe receiving semi-cylindrical internal portion of saddle portion 44 opens upwardly, saddle portion 44 has a nipple 52 extending upwardly from a central location thereof. An open passage 54 is provided centrally of nipple 52 and extends completely through body 32 to communicate with nozzle 42. As shown in FIG. 1, liquid from tank 12 flows through line 16, pump 14, line 18 when shut-off valve 20 is open to manifold 22. Some of the liquid is directed into the various branches of the system, including pipe 26. Liquid flows from pipe 26 into passage 54 for ejection from nozzle 42. In this regard, passage 54 opens into the interior of pipe 26. Pipe 26 includes openings 55 along the lower most portion of the pipe. The nipple of the various assemblies 30 extend into these openings to locate assemblies 30 at equal spacings along pipe 26. As shown in FIG. 4, nipple 52 extends completely through and above the opening in pipe 26. It is necessary that nipple 52 extend beyond the internal surface of pipe 26 in order to provide sufficiently strong structure to maintain nozzle assembly 30 at the desired location without breaking off nipple 52.

Figure 5:
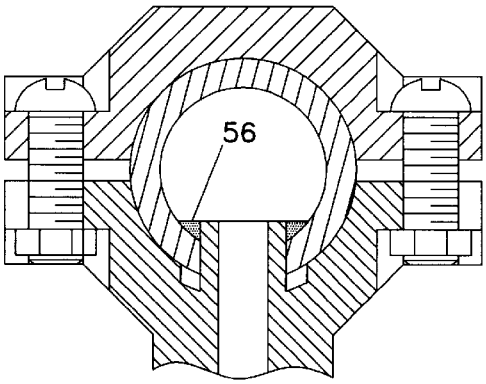
FIG. 5 ( PRIOR ART )
FIG. 5 is a view similar to FIG. 4 showing conventional spray nozzle apparatus.

As shown in FIG. 5, a conventional nozzle apparatus protrudes into the interior of a delivery pipe such that when liquid is no longer being pumped through the system, some of the liquid 56 remains in the region between nipple 58 and the inner surface 60 of the delivery pipe. The presence of the remnant liquid 56 is troublesome in that it is a costly waste of the liquid, it may result in some of the liquid being distributed as a first injection on a new field where such liquid is undesirable and in fact harmful, and it could result in a safety problem if it were expected that all previous liquid in the system had in fact been removed from the system. The present invention includes a notch 62 in the opposite walls of nipple 52 so that such notches 62 preferably extend beneath the inner surface 64 of pipe 26 along the longitudinal direction of pipe 26. As a result, when liquid from tank 12 is shut off at valve 20, all of the liquid will drain from the system since all liquid in pipe 26 will be allowed to flow through notches 62 into passage 54 and drain or be injected from nozzle 42.

It is understood that body 36 of apparatus 30 is representative. Body 36 could include multiple engagement portions 38 for nozzle tips 34. Body 36 could also include a check valve assembly or other stop-type valves. The details of body 36 beneath saddle portion 40 are not a part of the present invention.

Although characteristics and advantages of the present invention, together with details of structure and function, have been described or are clear from the present disclosure, it is understood that the disclosure is illustrative only. Changes made, especially in matters of shape, size and arrangement, to the full extent extended by the general meaning of the terms in which the appended claims are expressed, are considered to be within the principle of the invention.

We claim:

1. Spray nozzle apparatus for attachment to a pipe, said apparatus comprising a body with a saddle, said body including a nipple protruding up from said saddle so as to project through an opening in said pipe when said assembly is clamped to said pipe, said nipple having a notch in opposite walls so that liquid cannot accumulate between said nipple and the inner surface of said pipe.

2. The apparatus in accordance with claim 1 wherein said notches extend beneath the inner surface of the wall of said pipe when said body is clamped to said pipe.

* * * * *